US009752249B2

(12) United States Patent
Hiraoka et al.

(10) Patent No.: US 9,752,249 B2
(45) Date of Patent: Sep. 5, 2017

(54) FILM FORMING APPARATUS AND FILM FORMING METHOD

(71) Applicant: TOYOTA JIDOSHA KABUSHIKI KAISHA, Toyota-shi, Aichi-ken (JP)

(72) Inventors: Motoki Hiraoka, Toyota (JP); Hiroshi Yanagimoto, Miyoshi (JP); Yuki Sato, Nissin (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/062,293

(22) Filed: Mar. 7, 2016

(65) Prior Publication Data

US 2016/0265126 A1 Sep. 15, 2016

(30) Foreign Application Priority Data

Mar. 11, 2015 (JP) ..... 2015-048021

(51) Int. Cl.

| | |
|---|---|
| ***C25D 17/12*** | (2006.01) |
| ***C25D 17/00*** | (2006.01) |
| ***C25D 5/04*** | (2006.01) |
| ***C25D 5/08*** | (2006.01) |
| ***C25D 3/00*** | (2006.01) |
| *C25D 7/12* | (2006.01) |

(52) U.S. Cl.

CPC ..... *C25D 17/002* (2013.01); *C25D 3/00* (2013.01); *C25D 5/04* (2013.01); *C25D 5/08* (2013.01); *C25D 17/12* (2013.01); *C25D 7/123* (2013.01)

(58) Field of Classification Search

CPC ..... C25D 3/38; C25D 5/02; C25D 17/002; C25D 17/02; C25D 17/10

See application file for complete search history.

(56) References Cited

U.S. PATENT DOCUMENTS

| | | | | |
|---|---|---|---|---|
| 1,739,657 | A * | 12/1929 | Shemitz | C25D 17/14 204/224 R |
| 5,644,341 | A * | 7/1997 | Fujii | B41J 2/04541 347/11 |
| 6,033,540 | A * | 3/2000 | Kosaki | C25D 7/12 204/224 R |
| 6,416,647 | B1 | 7/2002 | Dordi et al. | |
| 6,485,627 | B1 * | 11/2002 | Johal | C25D 7/10 205/148 |
| 7,998,323 | B1 * | 8/2011 | Chandra | C25D 5/22 204/224 M |

(Continued)

FOREIGN PATENT DOCUMENTS

| | | | | |
|---|---|---|---|---|
| DE | 1917371 | * | 4/1971 | C02F 1/461 |
| JP | 3-226600 | A | 10/1991 | |
| JP | 2003-328190 | A | 11/2003 | |

(Continued)

*Primary Examiner* — Stefanie S Wittenberg
(74) *Attorney, Agent, or Firm* — Sughrue Mion, PLLC

(57) ABSTRACT

A film forming apparatus includes: an anode; a solid electrolyte membrane that is arranged between the anode and an substrate that serves as a cathode, and that contains metal ions; a power supply that applies a voltage between the anode and the substrate in a state in which the solid electrolyte membrane is in contact with the substrate from above; and an oscillating portion configured to oscillate at least the anode in the state in which the solid electrolyte membrane is in contact with the substrate.

4 Claims, 7 Drawing Sheets

(56) References Cited

U.S. PATENT DOCUMENTS

| | | | | |
|---|---|---|---|---|
| 2004/0016648 | A1* | 1/2004 | Lubomirsky | C25D 17/02 205/137 |
| 2005/0000820 | A1* | 1/2005 | Mishima | H01L 21/2885 205/118 |

FOREIGN PATENT DOCUMENTS

| | | | | |
|---|---|---|---|---|
| JP | 2004225119 | * | 8/2004 | C25D 17/14 |
| JP | 2004-250747 | A | 9/2004 | |
| JP | 2004-360028 | A | 12/2004 | |
| JP | 2014-51701 | A | 3/2014 | |
| JP | 2014-185371 | A | 10/2014 | |
| WO | 2015/019154 | A2 | 2/2015 | |

* cited by examiner

FILM FORMING APPARATUS AND FILM FORMING METHOD

INCORPORATION BY REFERENCE

The disclosure of Japanese Patent Application No. 2015-048021 filed on Mar. 11, 2015 including the specification, drawings and abstract is incorporated herein by reference in its entirety.

BACKGROUND OF THE INVENTION

1. Field of the Invention

The invention relates to a metal-film forming apparatus and a metal-film forming method capable of suitably forming a metal film by applying voltage between an anode and substrate, and depositing metal from metal ions contained in a solid electrolyte membrane onto a surface of the substrate.

2. Description of Related Art

Conventionally, when manufacturing an electronic circuit substrate or the like, a nickel film is formed on a surface of a substrate in order to form a nickel circuit pattern. As film forming technology of such a metal film, technology that forms a metal film by a plating process such as a non-electrolytic plating process, or that forms a metal film by a PVD method such as sputtering, on a surface of a semiconductor substrate of Si or the like, for example, has been proposed.

However, when a plating process such as a non-electrolytic plating process is performed, rinsing after the plating process is necessary, and the resultant waste water must then be disposed of. Also, when a film is formed on a substrate surface by a PVD method such as sputtering, internal stress is generated in the metal-film coating, so there is a limit as to just how thick the film can be. In particular, with sputtering, the film is only able to be formed in a high vacuum.

In view of this, Japanese Patent Application Publication No. 2014-51701 (JP 2014-51701 A), for example, proposes a metal-film forming apparatus that includes at least an anode, a substrate that is a cathode, a solid electrolyte membrane arranged between the anode and the cathode, and a power supply portion that applies a voltage between the anode and the cathode. With this film forming apparatus, a storing portion that stores electrolytic solution (that is, an aqueous solution in which metal salt has been dissolved) that includes metal ions is provided between the anode and the solid electrolyte membrane so as to contact both the anode and the solid electrolyte membrane.

When forming a metal film on the surface of the substrate, the metal film made of metal from metal ions is formed on the surface of the substrate by applying a voltage between the anode and the cathode, and depositing metal ions contained in the solid electrolyte membrane on the cathode side (see JP 2014-51701 A, for example).

SUMMARY OF THE INVENTION

However, when a film forming apparatus such as that described in JP 2014-51701 A is used, moisture in the electrolytic solution may decompose by an electric current and oxygen gas may be produced at the surface of the anode at the time of film forming. As the film forming time passes, the amount of oxygen gas that is produced increases, and the increased oxygen gas may condense and accumulate in a predetermined location at the surface of the anode. This kind of phenomenon may occur if the slightest amount of moisture is mixed in with the electrolytic solution at the time of forming, not only when the electrolytic solution is an aqueous solution that includes metal ions, but even if an electrolytic solution in which metal ions are included in a solvent other than water, such as alcohol, is used, for example.

Therefore, even if voltage is applied between the anode and the substrate that is the cathode, the flow of current from the location where the oxygen gas has accumulated (i.e., a part of the surface of the anode) toward the cathode may be impeded. As a result, a defect such as a pinhole may be produced in the formed metal film, or the thickness of the metal film may be uneven.

The invention thus provides a film forming apparatus and a film forming method capable of stably forming a metal film of uniform thickness having few defects.

A first aspect of the invention provides a film forming apparatus. The first aspect includes: an anode; a solid electrolyte membrane that is arranged between the anode and an substrate that serves as a cathode, and that contains metal ions; a power supply that applies a voltage between the anode and the substrate in a state in which the solid electrolyte membrane is in contact with the substrate from above; and an oscillating portion configured to oscillate at least the anode in the state in which the solid electrolyte membrane is in contact with the substrate.

In the first aspect, the film forming apparatus may include a liquid storing portion provided between the anode and the solid electrolyte membrane, the liquid storing portion storing an electrolytic solution that contains the metal ions in a manner such that the electrolytic solution contacts the anode and the solid electrolyte membrane.

According to this first aspect, when the voltage is applied between the anode and the cathode (the substrate) in a state in which the solid electrolyte membrane is contacting the substrate from above, the metal ions included in the solid electrolyte membrane move to the surface of the substrate that is in contact with the solid electrolyte membrane, and are reduced at the surface of the substrate. As a result, metal derived from the metal ions is deposited on the surface of the substrate, such that the metal film is formed.

On the other hand, even if moisture in the electrolytic solution decomposes by an electric current and oxygen gas is produced at the surface of the anode when the film is being formed, oxygen gas is able to be inhibited from accumulating in a predetermined location at the surface of the anode because the anode is oscillated by the oscillating portion. Therefore, As a result, a localized increase in electrical resistance between the anode and the substrate due to the accumulation of oxygen gas is able to be inhibited. Therefore, pinholes in the metal film and unevenness in the thickness of the metal film are able to be inhibited from occurring.

In the above aspect, the liquid storing portion may include a liquid supply port that supplies the electrolytic solution into the liquid storing portion, and a liquid discharge port that discharges the electrolytic solution from within the liquid storing portion. The liquid supply port and the liquid discharge port may be provided such that the electrolytic solution flows between the anode and the solid electrolyte membrane.

According to the aspect described above, the metal film is able to be formed while flowing the electrolytic solution between the anode and the solid electrolyte membrane, by supplying electrolytic solution from the liquid supply port and discharging electrolytic solution from the liquid discharge port. Therefore, the oxygen gas produced at the anode is able to be discharged, together with the electrolytic solution, from the liquid discharge port.

In the aspect described above, the liquid discharge port may be provided in a position higher than the liquid supply port.

Oxygen gas produced at the anode has a lighter specific gravity than the electrolytic solution, so it tends to move upward more easily through the electrolytic solution. According to the above aspect, a flow of electrolytic solution that is inclined upward from the liquid supply port toward the liquid discharge port is able to be formed by forming the liquid discharge port in a position higher than the liquid supply port. Therefore, oxygen gas produced at the anode is easily discharged with the electrolytic solution from the liquid discharge portion.

In the above aspect, a surface of the anode that faces the solid electrolyte membrane may be inclined upward with respect to a horizontal plane, in a direction from the liquid supply port toward the liquid discharge port.

According to this aspect, the oxygen gas produced at the surface of the oscillating anode easily moves upward along the inclined surface of the anode, from the liquid supply port toward the liquid discharge port. As a result, the oxygen gas produced at the anode is easily discharged, together with the electrolytic solution, from the liquid discharge port.

In the aspect described above, the film forming apparatus may include a gas discharge port that discharges gas that is inside the liquid storing portion. The gas discharge port may be provided in a position higher than the liquid discharge port, between the liquid supply port and the liquid discharge port, the gas discharge port being provided closer to the liquid discharge port than the liquid supply port.

According to this aspect, the gas discharge port is formed in a position higher than the liquid discharge port. Therefore, the oxygen gas produced at the anode is able to be discharged from the gas discharge port before being discharged from the liquid discharge port. Consequently, the amount of oxygen gas included in the electrolytic solution that is discharged from the liquid discharge port is able to be reduced. As a result, the electrolytic solution is able to be suitably reused, e.g., the electrolytic solution is able to be circulated to the apparatus.

In the first aspect in which the film forming apparatus includes a liquid storing portion, the anode may include a first surface that faces the solid electrolyte membrane; a second surface that is on a side opposite the first surface; and a through-hole provided from the first surface through to the second surface.

According to this aspect, the oxygen gas produced at the surface facing the solid electrolyte membrane, from among the surfaces of the anode, is able to be passed through the plurality of through-holes and discharged to the other surface of the anode by oscillation of the anode by the oscillating portion.

In the aspect described above, the liquid storing portion may include a liquid supply port that supplies the electrolytic solution into the liquid storing portion, and a liquid discharge port that discharges the supplied electrolytic solution. The liquid discharge port may be provided on a second surface side with respect to the anode.

According to this aspect, the produced oxygen gas is able to be passed, together with the electrolytic solution, through the through-holes in the anode, from one surface toward the other surface of the anode, and discharged from the liquid discharge port.

A second aspect of the invention provides a film forming method. The second aspect includes: placing a solid electrolyte membrane that includes metal ions in contact a substrate from above, by arranging the solid electrolyte membrane between an anode and the substrate that serves as a cathode; oscillating at least the anode in a state in which the solid electrolyte membrane is contacting the substrate; and forming the metal film on a surface of the substrate by applying a voltage between the anode and the substrate and reducing the metal ions in the state in which the solid electrolyte membrane is contacting the substrate.

The second aspect may include storing an electrolytic solution that contains metal ions such that the electrolytic solution is in contact with the anode and the solid electrolyte membrane, between the anode and the solid electrolyte membrane.

According to this second aspect, when the voltage is applied between the anode and the cathode (the substrate) in a state in which the solid electrolyte membrane is contacting the substrate from above, the metal ions included in the solid electrolyte membrane move to the surface of the substrate that is in contact with the solid electrolyte membrane, and are reduced at the surface of the substrate. As a result, metal derived from the metal ions is deposited on the surface of the substrate, such that the metal film is formed.

On the other hand, even if moisture in the electrolytic solution decomposes by an electric current and oxygen gas is produced at the surface of the anode when the film is being formed, the oxygen gas is able to be inhibited from accumulating in a certain location at the surface of the anode because the anode is oscillated. As a result, pinholes in the metal film and unevenness in the thickness of the metal film are able to be inhibited from occurring.

In the second aspect, the film forming may be performed while flowing the electrolytic solution between the anode and the solid electrolyte membrane.

According to this aspect, the metal film is able to be formed while flowing the electrolytic solution between the anode and the solid electrolyte membrane. Therefore, the oxygen gas produced at the anode is able to be discharged together with the electrolytic solution.

In the aspect described above, the film forming may be performed in a state in which the anode is arranged such that a surface of the anode that faces the solid electrolyte membrane is inclined upward with respect to a horizontal plane, in a direction from an upstream side toward a downstream side of a flow of the electrolytic solution between the anode and the solid electrolyte membrane.

According to this aspect, the oxygen gas produced at the surface of the oscillating anode easily moves upward along the inclined surface of the anode. As a result, the oxygen gas produced at the anode is easily discharged, together with the electrolytic solution, from between the anode and the solid electrolyte membrane.

In the aspect described above, the anode may include a first surface that faces the solid electrolyte membrane; a second surface that is on a side opposite the first surface; and a through-hole provided from the first surface through to the second surface.

According to this aspect, the oxygen gas produced at the surface facing the solid electrolyte membrane, from among the surfaces of the anode, is able to be passed through the plurality of through-holes and discharged to the other surface of the anode by oscillation of the anode by the oscillating portion.

In the above aspect, the film forming may be performed while passing the electrolytic solution through the through-hole, from the first surface toward the second surface. The electrolytic solution may be between the anode and the solid electrolyte membrane.

In the aspects described above, the produced oxygen gas is able to be passed, together with the electrolytic solution that is between the anode and the solid electrolyte membrane, through the through-holes in the anode, from one surface toward the other surface of the anode, and discharged to the other surface side of the anode.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a film forming apparatus capable of suitably carrying out a metal-film forming method according to example embodiments of the invention will be described.

Figure 1A:
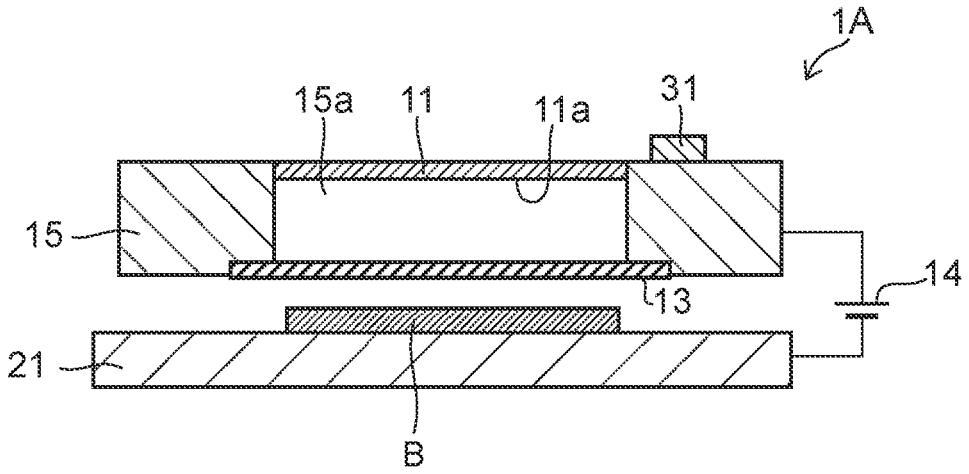
FIG. 1A is a sectional view showing a frame format of a state of a metal-film forming apparatus according to a first example embodiment of the invention before forming a film.
Figure 1B:
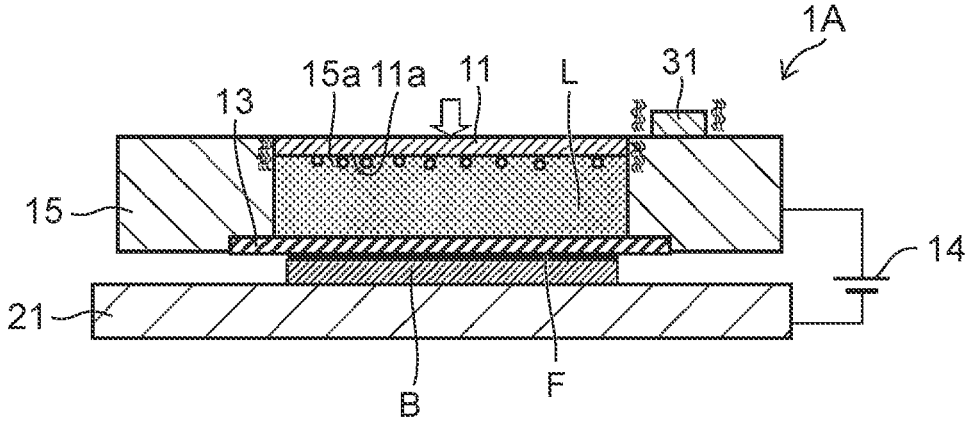
FIG. 1B is a sectional view showing a frame format of a state of the film forming apparatus according to the first example embodiment of the invention when a film is being formed.

FIGS. 1A and 1B are conceptual diagrams showing frame formats of a film forming apparatus 1A for forming a metal film F according to a first example embodiment of the invention. FIG. 1A is a sectional view showing a frame format of a state of the film forming apparatus 1A before forming a film, and FIG. 1B is a sectional view showing a frame format of a state of the film forming apparatus 1A when a film is being formed.

As shown in FIGS. 1A and 1B, the film forming apparatus 1A is an apparatus that deposits metal from metal ions, and forms a metal film from the deposited metal on a surface of a substrate B. Here, a substrate made of metal material such as aluminum, or a substrate formed by forming a metal base layer on a treated surface of a resin or silicon substrate, may be used as the substrate B.

The film forming apparatus 1A includes at least a metal anode 11, a solid electrolyte membrane 13 arranged between the anode 11 and the substrate B that serves as a cathode, and a power supply 14 that applies a voltage between the anode 11 and the substrate B. Although not shown in detail in FIG. 1, the anode 11 is electrically connected to a positive electrode of the power supply 14 via a casing 15, and the substrate B that serves as the cathode is electrically connected to a negative electrode of the power supply 14 via a loading stand 21. The casing 15 is made of material that is insoluble with respect to electrolytic solution L that will be described later.

The solid electrolyte membrane 13 and the anode 11 are arranged apart from each other in the casing 15, such that the solid electrolyte membrane 13 and the anode 11 are not contacting one another. A liquid storing portion 15*a* that stores a solution L that includes metal ions (hereinafter, this solution will be referred to as "electrolytic solution") is formed between the solid electrolyte membrane 13 and the anode 11. Here, the liquid storing portion 15*a* is formed such that the stored electrolytic solution L directly contacts the anode 11 and the solid electrolyte membrane 13.

The anode 11 has a shape corresponding to a film forming region of the substrate B. The anode 11 according to this example embodiment as well as second to fourth example embodiments that will be described later may be a porous body, but more preferably is a non-porous body. By using the anode 11 that is a non-porous body, the metal film F formed on the substrate B will not easily be affected by the state of the surface of the anode 11.

The material of the anode 11 may be ruthenium oxide, platinum, or iridium oxide or the like that are insoluble with respect to the electrolytic solution L. Also, the anode 11 may be made of these metals covered by a copper sheet or the like. In this example embodiment, the anode 11 is more preferably a soluble anode made of the same metal as the metal of the metal film F (i.e., the metal of the metal ions in the electrolytic solution L). Electrolysis of the metal of the anode 11 is induced by a lower voltage than electrolysis of water, so oxygen gas that will be described later is able to be inhibited from being produced in a surface 11*a* of the anode 11.

The electrolytic solution L may be an electrolytic solution that includes ions of copper, nickel, or silver, for example. For example, with nickel ions, the electrolytic solution L may be an aqueous solution that includes nickel chloride, nickel sulfate, or nickel sulfamate or the like. Also, the solid electrolyte membrane 13 may be a membrane or film made of solid electrolyte or the like.

The solid electrolyte membrane 13 is not particularly limited as long as it is able to be impregnated with metal ions by being brought into contact with the electrolytic solution L described above, and metal derived from the metal ions is able to be deposited on the surface of the substrate B when voltage is applied. As the material of the solid electrolyte membrane, a fluorine resin such as Nafion (trade name) by DuPont or the like, a hydrocarbon resin, a polyamic resin, or a resin having an ion-exchange function such as SELEMION™ (CMV, CMD, CMF series) or the like by Asahi Glass Co., Ltd. may be used, for example.

Here, when depositing metal from the metal ions when forming the film, oxygen gas is produced at the anode 11 by an electrolysis reaction ($2H_2O \rightarrow O_2+4H^++4e^-$) of the moisture contained in the electrolytic solution L. When the electrolytic solution L is an aqueous solution, this kind of reaction takes place, producing oxygen gas. Even if the electrolytic solution L is not an aqueous solution, oxygen gas is produced when moisture is mixed into the electrolytic solution L. As the film formation time passes, the amount of oxygen gas that is produced also increases. This increased oxygen gas condenses and may end up accumulating in a particular location at the surface 11*a* of the anode 11 (i.e., the surface 11*a* that faces the solid electrolyte membrane 13). Consequently, when voltage is applied by the power supply 14, the flow of current from the location where the oxygen gas has accumulated (i.e., the surface of the anode 11) toward the substrate B is locally impeded. As a result, a defect such as a pinhole may be produced in the formed metal film F, or the thickness of the metal film may be uneven. Therefore, in this example embodiment, the film forming apparatus 1A is provided with an oscillating portion 31.

The oscillating portion 31 is a portion that oscillates at least the anode 11 in a state in which the solid electrolyte membrane 13 is contacting the substrate B. In this example embodiment, the oscillating portion 31 is mounted to the casing 15. In this example embodiment, the oscillating portion 31 is mounted to the casing 15, but as long as the anode 11 is able to be oscillated in a state in which the solid electrolyte membrane 13 is contacting the substrate B, the oscillating portion 31 may also be mounted to the loading stand 21, or may be directly mounted to the anode 11, for example.

The oscillating portion 31 is not particularly limited in terms of the oscillating direction, amplitude, and frequency and the like as long it is able to oscillate the anode 11 when forming a film, and move the oxygen gas from a predetermined location so that the oxygen gas does not accumulate in a predetermined location at the surface 11*a* of the anode 11 that will be described later.

However, the oscillating portion 31 preferably oscillates the anode 11 in a direction at least parallel to the surface 11*a* of the anode 11. In addition, the amplitude is preferably 1 to 15 mm and the frequency is preferably 5 to 7,000 Hz, for example. In this way, with the oscillating portion 31, oxygen gas produced at the surface 11*a* of the anode 11 is able to easily move by being oscillated in a direction parallel to the surface 11*a* of the anode 11. Moreover, with the oscillating portion 31, if oscillation in a direction perpendicular to the surface 11*a* of the anode 11 is also taken into account, the oxygen gas adhered to the surface 11*a* of the anode 11 is able to be temporarily desorbed, so the oxygen gas produced at the surface 11*a* of the anode 11 is able to be easily moved.

Hereinafter, the film forming method according to this example embodiment will be described. First, the substrate B is placed on the loading stand 21, and electrolytic solution L is stored in the liquid storing portion 15*a* of the casing 15. Next, the alignment of the substrate B with respect to the anode 11 is adjusted, and the temperature of the substrate B is adjusted. Then the casing 15 is arranged above the substrate B, the solid electrolyte membrane 13 is brought into contact with the substrate B from above, and the solid electrolyte membrane 13 is pressed onto the substrate B with a constant pressure. Here, in this example embodiment, the film forming apparatus 1A is not provided with a pressing portion (device) that presses down by hydraulic pressure or pneumatic pressure, but the solid electrolyte membrane 13 may also be pressed down onto the substrate B with a constant pressure from above the casing 15 using a pressing portion. In this state, the anode 11 and the substrate B that serves as the cathode are electrically connected to the power supply 14.

In this example embodiment, voltage is applied between the anode 11 and the substrate B that serves as the cathode using the power supply 14 while oscillating the anode 11 with the oscillating portion 31, while the solid electrolyte membrane 13 is made to contact the substrate B. As a result, metal ions contained in the solid electrolyte membrane 13 move to the surface of the substrate B that is contacting the solid electrolyte membrane 13, and are reduced at the surface of the substrate B. As a result, metal is deposited on the surface of the substrate B, such that the metal film F is formed on the surface of the substrate B. At this time, the electrolytic solution L is stored in the liquid storing portion 15*a*, so the metal ions are able to be constantly supplied to the solid electrolyte membrane 13.

Furthermore, even if moisture in the electrolytic solution L decomposes by an electric current and oxygen gas (the plurality of white circles in FIG. 1B) is produced at the surface of the anode when the film is being formed, oxygen gas is able to be inhibited from accumulating in a particular location at the surface 11*a* of the anode 11 because the anode 11 is able to be oscillated by the oscillating portion 31. Consequently, the impeding of movement of electrons between the anode 11 and the substrate B (a localized increase in electrical resistance) due to oxygen gas accumulating at the predetermined location is able to be inhibited. As a result, a localized decrease in the film forming rate of the metal film F is able to be reduced, so pinholes in the metal film F and unevenness in the thickness of the metal film F are able to be inhibited from occurring.

Figure 2A:
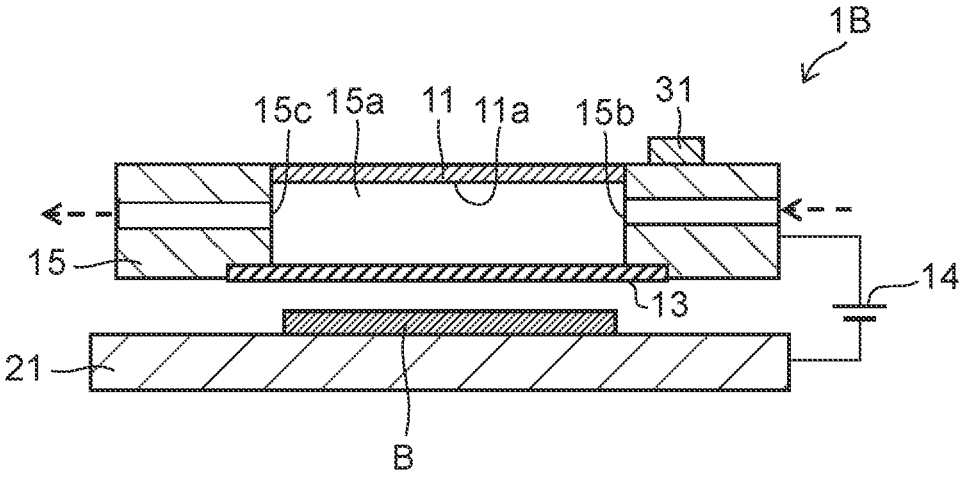
FIG. 2A is a sectional view showing a frame format of a state of a metal-film forming apparatus according to a second example embodiment of the invention before forming a film.
Figure 2B:
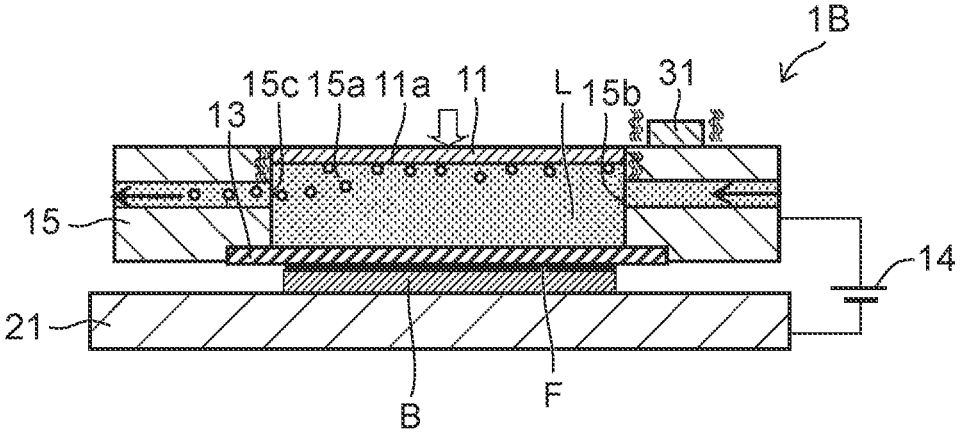
FIG. 2B is a sectional view showing a frame format of a state of the film forming apparatus according to the second example embodiment of the invention when a film is being formed.

FIGS. 2A and 2B are conceptual diagrams showing frame formats of a film forming apparatus 1B for forming a metal film F according to a second example embodiment of the invention. FIG. 2A is a sectional view showing a frame format of a state of the film forming apparatus 1B before a film is formed, and FIG. 2B is a sectional view showing a frame format of a state of the film forming apparatus 1B when a film is being formed. This example embodiment differs from the first example embodiment in that a liquid supply port 15*b* and a liquid discharge port 15*c* are provided in the liquid storing portion 15*a*. Therefore, the other structure that is common to the first example embodiment and this example embodiment will be denoted by like reference characters, and a detailed description of that structure will be omitted.

In this example embodiment, the liquid supply port 15*b* that supplies the electrolytic solution L into the liquid storing portion 15*a*, and the liquid discharge port 15*c* that discharges the electrolytic solution L from within the liquid storing portion 15*a*, are formed in the liquid storing portion 15*a*, as shown in FIG. 2A. The liquid supply port 15*b* and the liquid discharge port 15*c* are formed such that the electrolytic solution L is able to flow between the anode 11 and the solid electrolyte membrane 13.

In this way, the metal film F is able to be formed while flowing the electrolytic solution L between the anode 11 and the solid electrolyte membrane 13, by supplying the electrolytic solution L from the liquid supply port 15*b*, and discharging the electrolytic solution L from the liquid discharge port 15*c*, as shown in FIG. 2B. As a result, oxygen gas produced at the anode 11 is able to be discharged from the liquid discharge port 15*c* together with the electrolytic solution L. Thus, a metal film of uniform thickness with few defects is able to be stably formed.

In this example embodiment, the film forming apparatus 1B may also be provided with a circulation mechanism, not shown, for circulating the electrolytic solution L inside the liquid storing portion 15*a*. This kind of circulation mechanism makes it possible to supply the electrolytic solution L of which the concentration of metal ions has been adjusted to a predetermined concentration from the liquid supply port 15*b* to the liquid storing portion 15*a*, and discharge the electrolytic solution L used when forming the film in the liquid storing portion 15*a* from the liquid discharge port 15*c*.

Figure 3A:
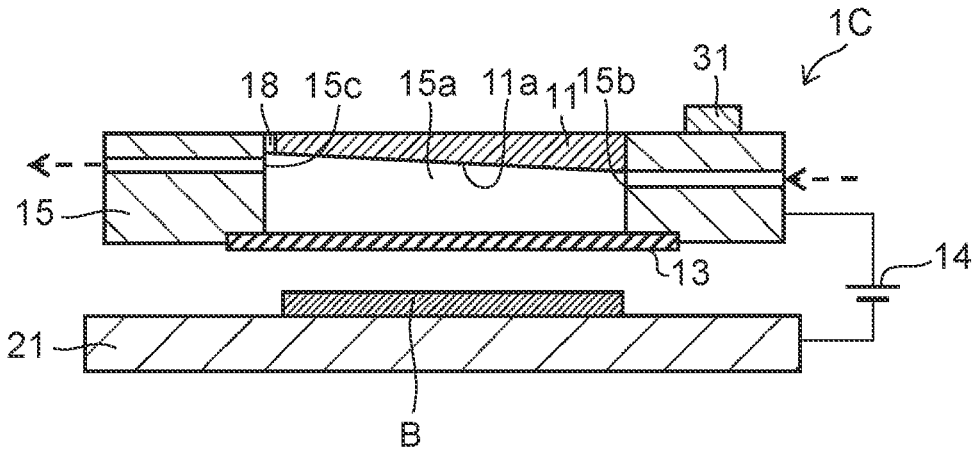
FIG. 3A is a sectional view showing a frame format of a state of a metal-film forming apparatus according to a third example embodiment of the invention before forming a film.
Figure 3B:
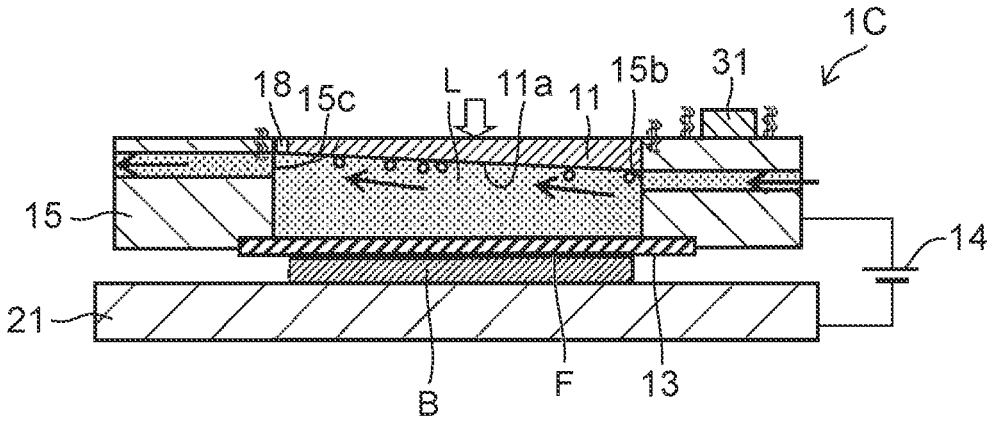
FIG. 3B is a sectional view showing a frame format of a state of the film forming apparatus according to the third example embodiment of the invention when a film is being formed.

FIGS. 3A and 3B are conceptual diagrams showing frame formats of a film forming apparatus 1C for forming a metal film F according to a third example embodiment of the invention. FIG. 3A is a sectional view showing a frame format of a state of the film forming apparatus 1C before a film is formed, and FIG. 3B is a sectional view showing a frame format of a state of the film forming apparatus 1C when a film is being formed. This example embodiment differs from the second example embodiment in terms of the positions of the liquid supply port 15*b* and the liquid discharge port 15*c* of the liquid storing portion 15*a*, the position of the surface 11*a* of the anode 11, and in that a gas discharge port 18 is newly provided. Therefore, the other structure that is common to the second example embodiment and this example embodiment will be denoted by like reference characters, and a detailed description of that structure will be omitted.

As shown in FIG. 3A, in this example embodiment, the liquid discharge port 15*c* is formed in a position higher than the liquid supply port 15*b*. The surface 11*a* of the anode 11 that faces the solid electrolyte membrane 13 is inclined upward with respect to the horizontal surface, from the liquid supply port 15*b* (on the upstream side of the flow of the solid electrolyte membrane 13) toward the liquid discharge port 15*c* (on the downstream side of the flow of the solid electrolyte membrane 13). More specifically, the liquid supply port 15*b* and the liquid discharge port 15*c* are formed near the surface 11*a* of the anode 11 such that the electrolytic solution L that flows between the anode 11 and the solid electrolyte membrane 13 will flow along the surface 11*a* of the anode 11.

Moreover, in this example embodiment, a gas discharge port 18 for discharging gas (oxygen gas) that is in the liquid storing portion 15*a* is formed in a position higher than the liquid discharge port 15*c*, near the liquid discharge port 15*c* (closer to the liquid discharge port 15*c* than the liquid supply port 15*b*), between the liquid supply port 15*b* and the liquid discharge port 15*c*, in the film forming apparatus 1C. More specifically, the gas discharge port 18 is formed in a position farthest downstream of the electrolytic solution L that flows along the surface 11*a* of the anode 11.

In this example embodiment, the gas discharge port 18 is formed between the anode 11 and the casing 15, but it may also be formed in the anode 11 or the casing 15. Also, it is alright if some of the electrolytic solution L flows out together with the oxygen gas from the gas discharge port 18, but a porous membrane or the like through which a gas such as oxygen gas is able to pass through but which a liquid such as the electrolytic solution L is unable to pass through, for example, may be formed in the gas discharge port 18 so that the electrolytic solution L does not flow out from the gas discharge port 18.

With the rotational axis C 1 according to this example embodiment, a flow of the electrolytic solution L that is inclined upward from the liquid supply port 15*b* toward the liquid discharge port 15*c* is able to be formed by forming the liquid discharge port 15*c* in a position higher than the liquid supply port 15*b*.

In particular, in this example embodiment, oxygen gas produced at the surface 11*a* of the anode 11 that is being oscillated is able to be moved together with the electrolytic solution L that flows along the inclined surface 11*a* of the anode 11. As a result, the oxygen gas is able to be moved from the surface of the anode 11, so most of the oxygen gas is able to be easily discharged from the gas discharge port 18.

In particular, oxygen gas tends to accumulate near the liquid discharge port 15*c* formed in the liquid storing portion 15*a*. In this example embodiment, the gas discharge port 18 is formed in the position described above. Therefore, most of the oxygen gas produced at the anode 11 is able to be discharged from the gas discharge port 18 before being discharged from the liquid discharge port 15*c*. As a result, the amount of oxygen gas included in the electrolytic solution L that is discharged from the liquid discharge port 15*c* is able to be reduced, so the discharged electrolytic solution L is able to be appropriately reused, e.g., the electrolytic solution L is able to be circulated to the film forming apparatus 1C.

Figure 4A:
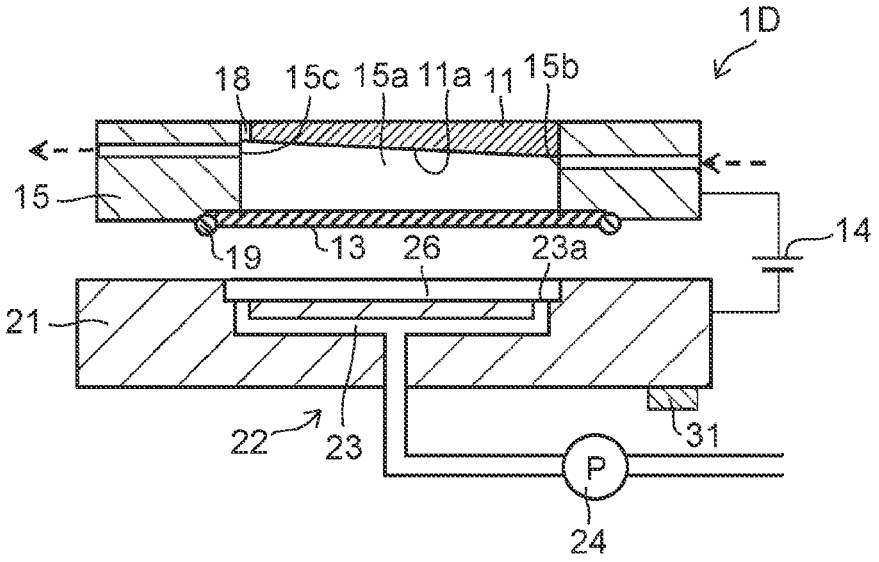
FIG. 4A is a sectional view showing a frame format of a state of a metal-film forming apparatus according to a fourth example embodiment of the invention before forming a film.
Figure 4B:
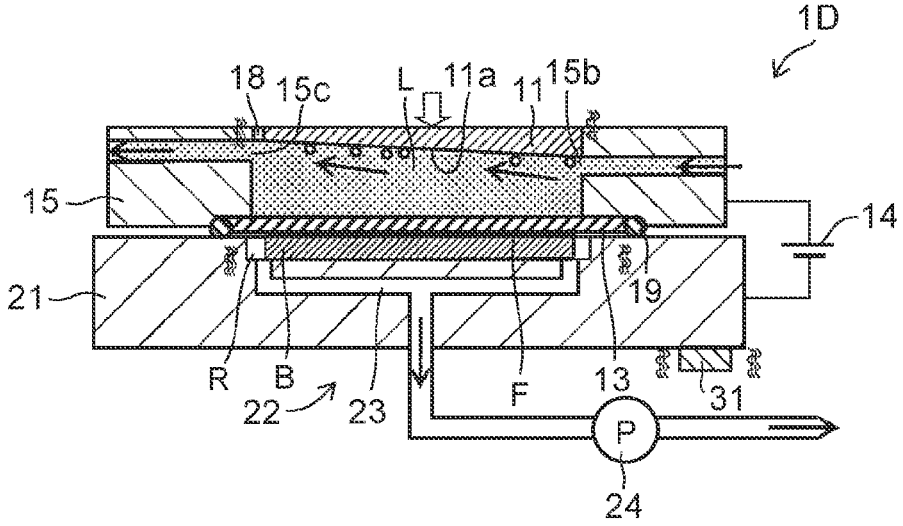
FIG. 4B is a sectional view showing a frame format of a state of the film forming apparatus according to the fourth example embodiment of the invention when a film is being formed.

FIGS. 4A and 4B are conceptual diagrams showing frame formats of a film forming apparatus 1D for forming a metal film F according to a fourth example embodiment of the invention. FIG. 4A is a sectional view showing a frame format of a state of the film forming apparatus 1D before a film is formed, and FIG. 4B is a sectional view showing a frame format of a state of the film forming apparatus 1D when a film is being formed.

Figure 5A:
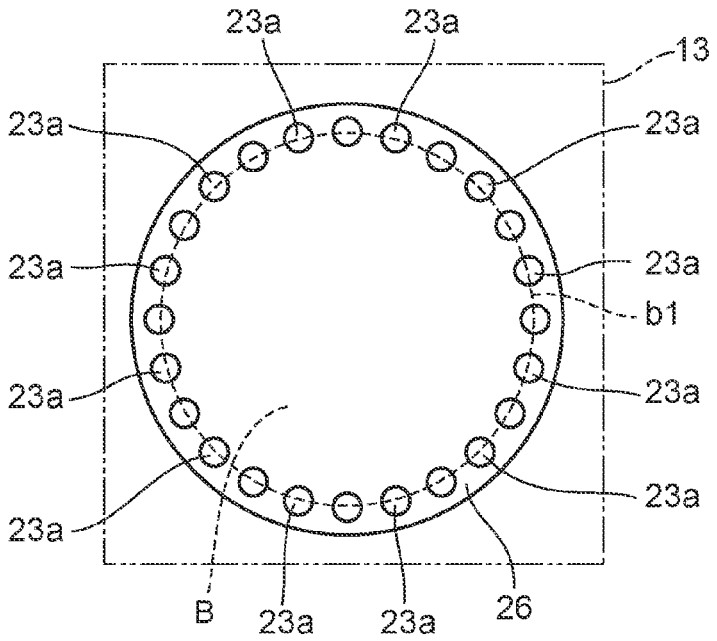
FIG. 5A is a plan view of the positional relationship between a substrate, a film suction port of a suction portion, and a solid electrolyte membrane of the film forming apparatus shown in FIG. 4.
Figure 5B:
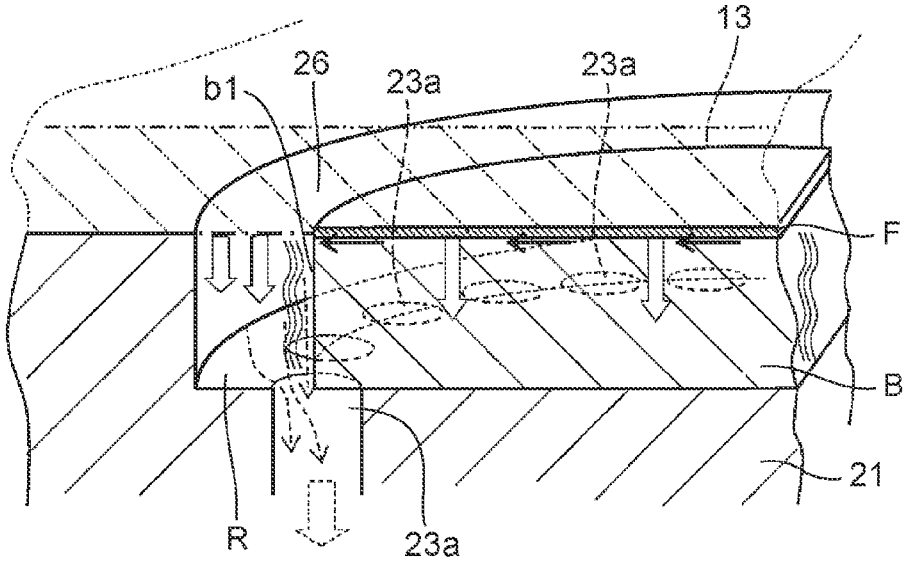
FIG. 5B is a perspective sectional view showing a frame format of a state around the film suction port of the film forming apparatus shown in FIG. 5A.

FIG. 5A is a plan view of the positional relationship between the substrate B, film suction ports 23*a* of a suction portion 22, and the solid electrolyte membrane 13 of the film forming apparatus 1D shown in FIG. 4. FIG. 5B is a perspective sectional view showing a frame format of the state around the film suction ports 23*a* of the film forming apparatus 1D shown in FIG. 4A, when the film is being formed. This example embodiment differs from the third example embodiment in terms of the structure of the loading stand 21, the position of the oscillating portion 31, and in that the suction portion 22 and an O-ring 19 are newly provided. Therefore, the other structure that is common to the third example embodiment and this example embodiment will be denoted by like reference characters, and a detailed description of that structure will be omitted.

In this example embodiment, the film forming apparatus 1D includes the suction portion 22 that suctions the solid electrolyte membrane 13 from the substrate B (loading stand 21) side such that the solid electrolyte membrane 13 closely contacts the surface of the substrate B that is placed on the loading stand 21, when forming the metal film F.

The suction portion 22 has a film suction passage 23, and a suction pump 24 that is connected to one end of the film suction passage 23. A housing recessed portion 26 for housing the substrate B is formed on the loading stand 21, and a plurality of film suction ports 23*a* are formed in a bottom surface of the housing recessed portion 26 (the surface of the loading stand 21). The plurality of film suction ports 23*a* are suction ports for suctioning the solid electrolyte membrane 13, and are formed in the other end of the film suction passage 23, and form a portion thereof.

Here, the depth of the housing recessed portion 26 matches the thickness of the substrate B, or is shallower than the thickness of the substrate B. As a result, when the substrate B is housed in the housing recessed portion 26, the surface of the substrate B and the surface of the loading stand 21 are on the same plane, or the surface of the substrate B is above the surface of the loading stand 21. In this way, the solid electrolyte membrane 13 is able to be suctioned by the suction portion 22 while the solid electrolyte membrane 13 blocks off the opening of the housing recessed portion 26, so the substrate B is able to be pressed on with stronger suction by the solid electrolyte membrane 13.

Furthermore, in this example embodiment, the plurality of film suction ports 23*a* are formed at equidistant intervals along a peripheral edge portion b1 of the substrate B that has been placed on the loading stand 21, as shown in FIGS. 5A and 5B. The film suction ports 23*a* are formed such that the peripheral edge portion of the substrate B covers a portion of each film suction port 23*a*, when the substrate B is arranged (placed) in the housing recessed portion 26 of the loading stand 21. Moreover, an annular groove R is formed around the substrate B, between the housing recessed portion 26 and the substrate B, by housing the substrate B in the housing recessed portion 26.

Further, in this example embodiment, the oscillating portion 31 is mounted to the loading stand 21 so that the loading stand 21 oscillates (more specifically, so that the substrate B oscillates). The oscillating portion 31 also oscillates the anode 11 with the solid electrolyte membrane 13 contacting the substrate B, similar to the oscillating portion in the first to the third example embodiments. Here, the oscillating portion 31 is mounted to the loading stand 21, but one may also be mounted to both the loading stand 21 and the casing 15. As a result, the anode 11 and the substrate B are able to be oscillated in individual oscillating patterns. As long as the formation of the metal film F is not impeded, the oscillating portion 31 may oscillate in either a direction parallel to the surface of the substrate B or a direction perpendicular to the surface of the substrate B, or may oscillate in both of these directions.

Here, when forming the film, the annular groove R is formed around the substrate B, between the housing recessed portion 26 and the substrate B, as shown in FIG. 5B, in a state in which the substrate B is housed in the housing recessed portion 26. The space in the annular groove R has a negative pressure by the suction from the film suction ports 23*a*. Therefore, the solid electrolyte membrane 13 that contacts the peripheral edge portion b1 of the substrate B is able to be more effectively suctioned, so the solid electrolyte membrane 13 is able to be evenly pressed against the surface of the substrate B. In particular, the solid electrolyte membrane 13 is suctioned while the peripheral edge portion b1 of the substrate B covers a portion of each film suction port 23*a*, so stronger suction is able to be applied to the solid electrolyte membrane 13 that contacts the peripheral edge portion b1 of the substrate B.

Moreover, in this example embodiment, the O-ring 19 is arranged surrounding the solid electrolyte membrane 13 on the casing 15. Therefore, when the film is being formed, the O-ring 19 acts as a sealing member that forms an enclosed space between the solid electrolyte membrane 13 and the loading stand 21 on which the substrate B is placed. As a result, the suction portion 22 suctions the area inside the enclosed space, so the solid electrolyte membrane 13 is able to be effectively pressed against (made to closely contact) the surface of the substrate B.

As described above, the plurality of film suction ports 23*a* are arranged along the peripheral edge portion b1 of the substrate B, and further, a portion of each film suction port 23*a* that is not covered by the peripheral edge portion b1 is adjacent to the peripheral edge portion b1 of the substrate B. Therefore, stronger suction is able to be applied to the solid electrolyte membrane 13 that contacts near the peripheral edge portion of the substrate B. As a result, pressure is able to be applied evenly to the entire film forming region of the substrate B. Consequently, the solid electrolyte membrane 13 is able to uniformly follow the surface (the film forming region) of the substrate B.

Moreover, the metal film is able to be formed on the surface of the substrate B while discharging gas (hydrogen gas) produced at the substrate B that is the cathode from the film suction ports 23*a* while forming the film (see the solid arrows in FIG. 5B), by forming the metal film F while oscillating the substrate B by the oscillating portion 31.

Figure 6A:
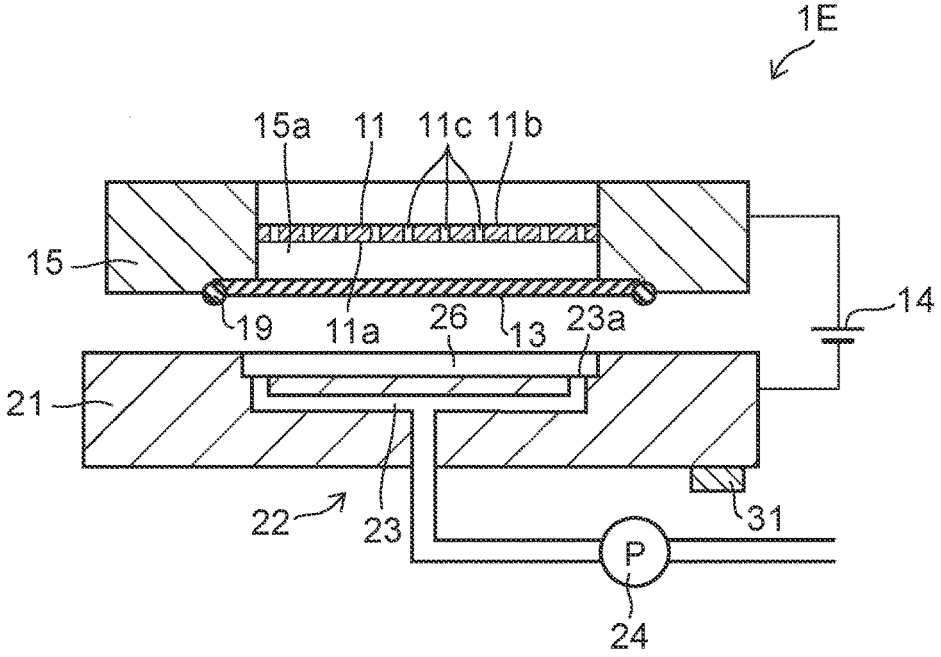
FIG. 6A is a sectional view showing a frame format of a state of a metal-film forming apparatus according to a fifth example embodiment of the invention before forming a film.
Figure 6B:
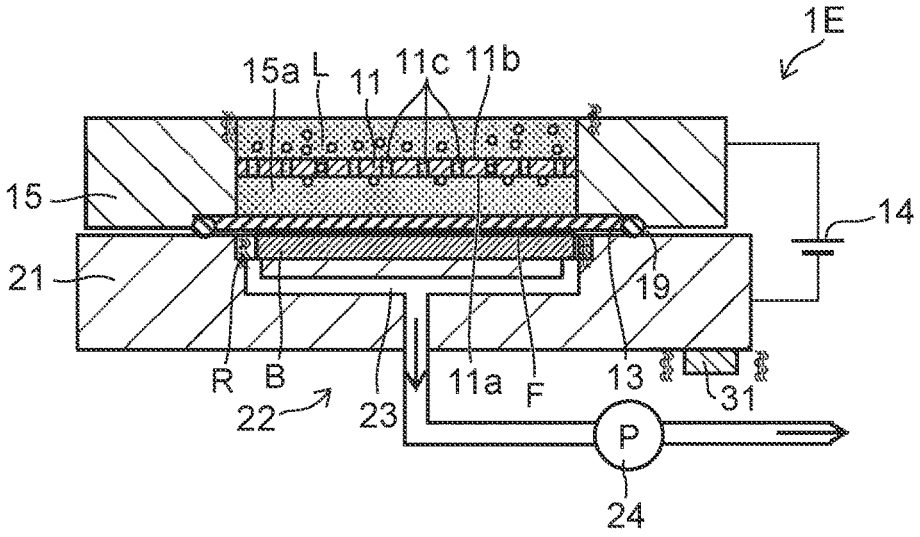
FIG. 6B is a sectional view showing a frame format of a state of the film forming apparatus according to the fifth example embodiment of the invention when a film is being formed.

FIGS. 6A and 6B are conceptual diagrams showing frame formats of a film forming apparatus 1E for forming a metal film F according to a fifth example embodiment of the invention. FIG. 6A is a sectional view showing a frame format of a state of the film forming apparatus 1E before a film is formed, and FIG. 6B is a sectional view showing a frame format of a state of the film forming apparatus 1E when a film is being formed. This example embodiment differs from the fourth example embodiment in terms of the structure of the anode 11 and the casing 15. Therefore, the other structure that is common to the fourth example embodiment and this example embodiment will be denoted by like reference characters, and a detailed description of that structure will be omitted.

In this example embodiment, when the surface facing the solid electrolyte membrane 13 is a first surface 11*a* and the surface on the opposite side from the surface 11*a* is a second surface 11*b*, a plurality of through-holes 11*c* are formed from the first surface 11*a* to the second surface 11*b*, in the anode 11. Here, the hole diameter of the through-holes 11*c* is set to a size at which there will be no pinholes or unevenness in the film when the film is formed.

The casing 15 in this example embodiment is open to the second surface 11*b* side (i.e., the upper side) of the anode 11. Also, in this example embodiment, the electrolytic solution L is stored inside the casing 15 on the other surface 11*b* side of the anode 11, as shown in FIG. 6B.

Using this kind of anode 11 enables oxygen gas produced at the first surface 11*a* of the anode 11 to pass through the plurality of through-holes 11*c* and be discharged to the second surface 11*b* of the anode 11 by oscillation of the anode 11 by the oscillating portion 31 when forming the film.

Figure 7A:
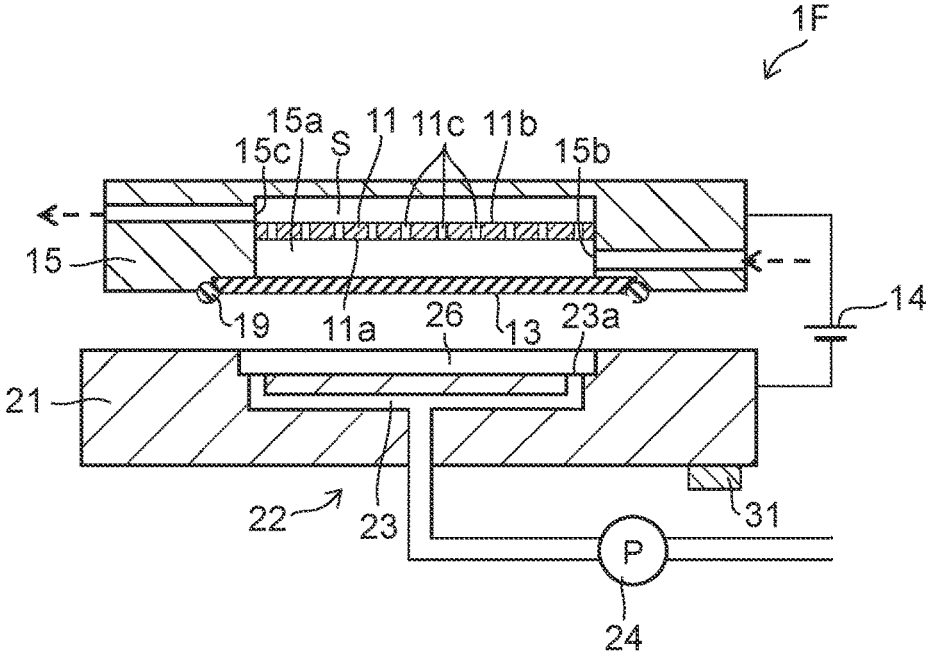
FIG. 7A is a sectional view showing a frame format of a state of a metal-film forming apparatus according to a sixth example embodiment of the invention before forming a film.
Figure 7B:
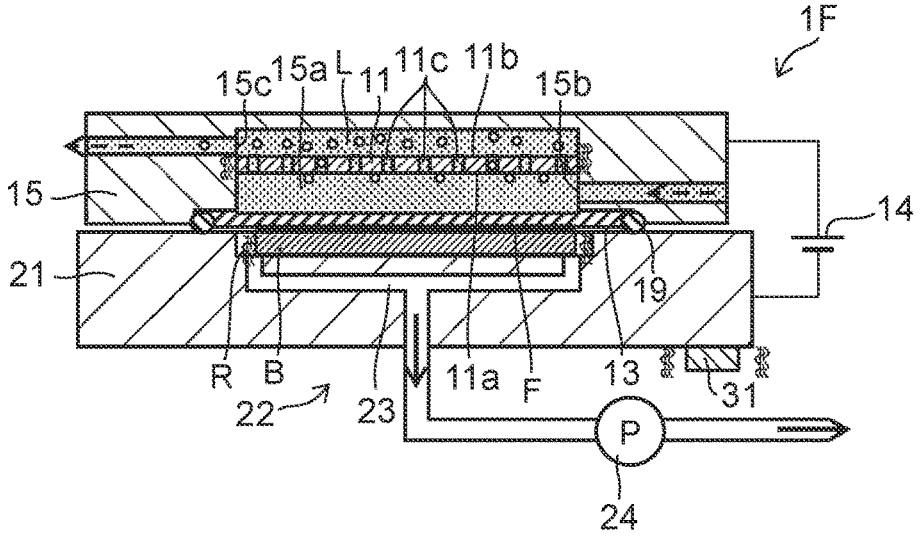
FIG. 7B is a sectional view showing a frame format of a state of the film forming apparatus according to the sixth example embodiment of the invention when a film is being formed.

FIGS. 7A and 7B are conceptual diagrams showing frame formats of a film forming apparatus 1F for forming a metal film F according to a sixth example embodiment of the invention. FIG. 7A is a sectional view showing a frame format of a state of the film forming apparatus 1F before a film is formed, and FIG. 7B is a sectional view showing a frame format of a state of the film forming apparatus 1F when a film is being formed. This example embodiment differs from the fifth example embodiment in terms of the structure of the casing 15, and in that the liquid supply port 15*b* and the liquid discharge port 15*c* are provided in the liquid storing portion 15*a*. Therefore, the other structure that is common to the fifth example embodiment and this example embodiment will be denoted by like reference characters, and a detailed description of that structure will be omitted.

In this example embodiment, the casing 15 differs from that in the fifth example embodiment in that it is not open to the upper side, and a liquid storing space S where electrolytic solution is stored is formed inside the casing 15. The liquid storing portion 15*a* is formed, just as in the fifth example embodiment, between the anode 11 and the solid electrolyte membrane 13. The liquid supply port 15*b* that supplies the electrolytic solution L into the liquid storing portion 15*a* is formed in the liquid storing portion 15*a*. In this example embodiment, the liquid discharge port 15*c* that discharges the electrolytic solution L is formed on the other surface 11*b* side of the anode 11.

With this kind of structure, the metal film F is able to be formed while passing the electrolytic solution L that is between the anode 11 and the solid electrolyte membrane 13 through the through-holes 11*c* of the anode 11, from the first surface 11*a* toward the second surface 11*b* of the anode 11.

Accordingly, oxygen gas produced at the anode 11, together with the electrolytic solution L that is between the anode 11 and the solid electrolyte membrane 13, is able to pass through the through-holes 11*c* of the anode 11 from the first surface 11*a* toward the second surface 11*b* of the anode 11, and be discharged from the second surface 11*b* of the anode 11 through the liquid discharge port 15*c*.

The liquid supply port 15*b* is provided in the liquid storing portion 15*a* between the anode 11 and the solid electrolyte membrane 13 so that the electrolytic solution L can be supplied. However, as long as the gas that is produced is able to be made to pass through the through-holes 11*c* in the anode 11 from the first surface 11*a* toward the second surface 11*b* of the anode 11 by the oscillating portion 31, the liquid supply port 15*b* may also be formed on the second surface 11*b* side of the anode 11.

The invention will now be described using the examples below.

First, Example 1, will be described. In Example 1, a pure aluminum substrate (50 mm×50 mm×1 mm thick) was prepared as the substrate in which a film is to be formed on a surface thereof. Then a nickel plating film was formed on the surface of the substrate, and further, a gold plating film was formed on the surface of this nickel plating film, and this was then washed with running deionized water.

Next, a copper film was formed using the film forming apparatus 1D according to the fourth example embodiment shown in FIG. 4A. A copper sulfate aqueous solution of 1.0 mol/L was used for the electrolytic solution, a Pt plate (made by The Nilaco Corporation) was used for the anode, and Nafion N212 (by DuPont) having a film thickness of 50 μm was used for the solid electrolyte membrane. A vibration exciter (BigWave: made by Asahi Seisakusyo) was used for the oscillating portion. As the test conditions, the copper film was formed during a film forming time of 10 minutes, with a current density of 5 mA/cm$^2$ and an electrolytic solution flowrate of 15 ml/min., while the anode was oscillated at a frequency of 300 Hz by the vibration exciter, while driving the suction pump to suction the solid electrolyte membrane to the substrate side such that the solid electrolyte membrane was in close contact with the substrate.

Next, Example 2, will be described. A copper film was formed similar to in Example 1. Example 2 differs from Example 1 in that the film forming apparatus 1E according to the sixth example embodiment shown in FIG. 7A was used. An anode having through-holes each with a hole area of 3.14 mm$^2$ was used.

Next, Example 3, will be described. A copper film was formed similar to in Example 1. Example 3 differs from Example 1 in that a copper anode (a soluble anode (made by The Nilaco Corporation)) was used for the anode.

Next, Comparative example 1 that is a comparative example with respect to the examples of the invention will be described. A copper film was formed just as in Example 1. Comparative example 1 differs from Example 1 in that the film forming apparatus 1B according to the second example embodiment shown in FIG. 2A was used, but the film was formed without oscillation by the oscillating portion.

The coverage of the copper film and the presence of pinholes therein according to Examples 1 to 3 and Comparative example 1 where then evaluated. The results are shown in Table 1.

TABLE 1

| | Coverage | Presence of pinholes |
|---|---|---|
| Example 1 | 100% | No |
| Example 2 | 100% | No |
| Example 3 | 100% | No |
| Comparative example 1 | 98% | Yes |

From Table 1, with Comparative example 1, it is thought that pinholes formed and the coverage of the copper film decreased because the resistance between the anode and the cathode (the substrate) locally increased due to the fact that oxygen gas remained in the surface of the anode.

Heretofore, example embodiments of the invention have been described in detail, but the invention is not limited to these example embodiments. That is, various design changes are possible without departing from the spirit of the invention.

For example, in the sixth example embodiment, the liquid storing portion that stores the electrolytic solution is provided between the anode and the solid electrolyte membrane. However, a film may also be formed while a porous anode that is capable of both allowing electrolytic solution to pass through it and discharging the oxygen gas that is produced is placed in direct contact with the solid electrolyte membrane and the anode is oscillated.

What is claimed is:

1. A film forming apparatus comprising:

an anode;

a solid electrolyte membrane that is arranged between the anode and a substrate that serves as a cathode, and that contains metal ions;

a power supply that applies a voltage between the anode and the substrate in a state in which the solid electrolyte membrane is in contact with the substrate from above;

an oscillating portion configured to oscillate at least the anode in the state in which the solid electrolyte membrane is in contact with the substrate; and a liquid storing portion provided between the anode and the solid electrolyte membrane, the liquid storing portion storing an electrolytic solution that contains the metal ions in a manner such that the electrolytic solution contacts the anode and the solid electrolyte membrane, wherein the liquid storing portion includes a liquid supply port that supplies the electrolytic solution into the liquid storing portion, and a liquid discharge port that discharges the electrolytic solution from within the liquid storing portion, the liquid supply port and the liquid discharge port being provided such that the electrolytic solution flows between the anode and the solid electrolyte membrane, wherein the liquid discharge port is provided in a position higher than the liquid supply port, wherein a surface of the anode that faces the solid electrolyte membrane is inclined upward with respect to a horizontal plane, in a direction from the liquid supply port toward the liquid discharge port.

2. The film forming apparatus according to claim 1, further comprising:

a gas discharge port that discharges gas that is inside the liquid storing portion, the gas discharge port being provided in a position higher than the liquid discharge port, between the liquid supply port and the liquid discharge port, the gas discharge port being provided closer to the liquid discharge port than the liquid supply port.

3. The film forming apparatus according to claim 1, wherein the anode includes a first surface that faces the solid electrolyte membrane;

a second surface that is on a side opposite the first surface; and a through-hole provided from the first surface through to the second surface.

4. The film forming apparatus according to claim 3, wherein the liquid discharge port is provided on a second surface side with respect to the anode.

* * * * *